US005585212A

United States Patent [19]

Ueda

[11] Patent Number: 5,585,212

[45] Date of Patent: Dec. 17, 1996

[54] PHOTOCONDUCTOR FOR ELECTROPHOTOGRAPHY

[75] Inventor: Hideaki Ueda, Kishiwada, Japan

[73] Assignee: Minolta Co., Ltd., Osaka, Japan

[21] Appl. No.: 395,883

[22] Filed: Feb. 28, 1995

[30] Foreign Application Priority Data

Mar. 2, 1994 [JP] Japan ..... 6-032541

[51] Int. Cl.[6] ..... G03G 5/047; G03G 5/06

[52] U.S. Cl. ..... 430/58; 430/59; 430/83; 430/96

[58] Field of Search ..... 430/58, 59, 83, 430/96

[56] References Cited

U.S. PATENT DOCUMENTS

| | | | |
|---|---|---|---|
| 4,800,144 | 1/1989 | Ueda et al. | 430/58 |
| 4,851,314 | 7/1989 | Yoshihara | 430/59 |
| 4,956,256 | 9/1990 | Ohtsuka et al. | 430/96 |
| 5,132,196 | 7/1992 | Hirayama et al. | 430/63 |
| 5,162,184 | 11/1992 | Aizawa | 430/96 X |
| 5,225,878 | 7/1993 | Asano et al. | 355/219 |
| 5,332,635 | 7/1994 | Tanaka | 430/96 |
| 5,382,449 | 1/1995 | Ojima et al. | 430/58 X |

*Primary Examiner*—Roland Martin

*Attorney, Agent, or Firm*—Burns, Doane, Swecker & Mathis, LLP

[57] ABSTRACT

A photoconductor for electrophotography comprising a photoconductive layer having a thickness of 27 micro-meter or more and including as a binder resin a first polycarbonate resin having a low molecular weight constituent which has a numerical average molecular weight being 10,000 or more and under 22,000, and a second polycarbonate resin having a high molecular weight constituent which has a numerical average molecular weight being 22,000 or more and under 38,000. The photoconductor has a high durability without toner filming, a wear resistance, a stable electrophotographic characteristics and an excellent cleaning characteristic.

18 Claims, 2 Drawing Sheets

PHOTOCONDUCTOR FOR ELECTROPHOTOGRAPHY

BACKGROUND OF THE INVENTION

1. Field of the Invention

The present invention relates to a photoconductor for electrophotography, and more specifically relates to a photoconductor having a thick film photoconductive layer and which provides excellent electrical characteristics and wear resistance characteristics.

2. Description of the Related Art

In recent years, there has been various research done relating to photoconductors, and photoconductors of the function-separated type have been developed wherein the photoconductive functions of charge-generating function and charge-transporting function are provided by separate materials. Typically, the photosensitive layer of photoconductors of the laminated, function-separated type comprise a laminate structure of a charge-generating layer including a charge-generating material, and a charge-transporting layer including a charge-transporting material and binding resin, whereas the photosensitive layer of photoconductors of the dispersed, function-separated type comprise a layer having a charge-generating material and a charge-transporting material dispersed within a binding resin.

Laminate type photoconductors of the aforesaid function-separated type allow a broad range of selectable materials, and can produce high performance photoconductors by allowing the inclusion of ideal materials for electrophotographic characteristics such as charging characteristics, sensitivity, residual electric potential, repetition characteristics and the like. Inexpensive photoconductors can be provided by application processes in production so as to make extremely high production possible, and photosensitive wavelength range can be freely controlled by suitably selecting charge-generating materials.

The aforesaid photoconductors, however, generally have reduced mechanical strength, and inferior wear resistance, and wearing of the photoconductor layer caused by loads occurring within the device under practical conditions such as friction with paper, friction with a cleaning member and the like reduces layer thickness. The amount of reduction of the layer due to friction differs depending on materials and processing, but a thickness reduction of about 0.2~1 μm after processing 10,000 sheets is typical. Reduction of layer thickness leads to a reduction in charging characteristics. When the range of permitted charging reduction is exceeded, the service life of the photoconductor is approached and, as a result, printing resistance deteriorates.

Methods for improving the sensitivity and wear resistance of photoconductors have included, for example, techniques for making the thickness of the photoconductor layer thicker than in the past.

When the thickness of a photoconductor layer is simply increased markedly, the service life of the photoconductor is certainly lengthened, but various disadvantages arise inasmuch as film thickness irregularity, and insufficient cleaning of the photoconductive member surface also occur. Furthermore, when processing of several hundred copy sheets has been accomplished, uneven density occurs in images, leading to unsharp images.

The previously mentioned disadvantages are largely the causes of damage, wear, and deterioration due to mechanical or physical external forces during printing resistance and particularly application state of charge-transporting layers, e.g., degree of applicability, of photoconductor layers and laminate layers. These factors are greatly dependent on the characteristics of the binding resin used in forming the photoconductor layer.

General immersion application methods may be used as photoconductive layer forming methods for photoconductors. Immersion application methods comprise immersing a substrate in a vessel filled with an application fluid, so as to form an application layer on the surface of the substrate by lifting the immersed substrate vertically at constant speed. Although immersion application methods allow relatively easy formation of uniform thin layers, when used for the formation of thick layers, the resin type and characteristics can cause variation in the application state of the layer and the characteristics of the photoconductor.

In general, when a high molecular weight resin is used as the binding resin of a photoconductor, the surface hardness of the photoconductor is increased, thereby providing excellent wear resistance, but conversely making it difficult to remove residual toner adhering to the surface of the photoconductor, such that image noise is produced due to a "filming" phenomenon. On the other hand, when low molecular weight resin is used as the binding resin, the aforesaid "filming" can be prevented, but the hardness of the resin is reduced, which tends to adversely affect wear resistance and make the photoconductor more susceptible to deterioration due to ozone and the like. Forming a thick photoconductor layer is difficult because when the viscosity of the binding resin is too great, a uniform application of the photoconductor layer cannot be achieved, and when said viscosity is too low, liquid runs occur which prevent uniform application of the layer.

When a resin having one type of molecular weight distribution is used as a binding resin, dispersions in the molecular weight distribution may occur by the manufacturing lot, thereby making it difficult to regulate the viscosity of the application liquid. This is disadvantageous from the perspective of manufacturing stability inasmuch as the strength of the application layer is not uniform.

SUMMARY OF THE INVENTION

Accordingly, a first object of the present invention is to provide a photoconductor having high sensitivity and excellent manufacturing stability which eliminates the previously described disadvantages associated with manufacturing a thick film photoconductor layer.

A second object of the present invention is to provide a photoconductor having excellent resolution power by inhibiting the production of image noise due to filming and the like even through repeated use.

The inventors conducted extensive research into eliminating the previously described disadvantages associated with photoconductors having a thick film photoconductive layer. The results of this research disclosed the previously described disadvantages were eliminated in conventional electrophotographic photoconductors by using not less than two types of polycarbonate resins having specific molecular weights as the binding resins of the photoconductive layer. Furthermore, applicability during manufacture of the photoconductor was improved as was manufacturing stability, and excellent mechanical strength and electrophotographic characteristics were maintained with high sensitivity over periods of long-term use. Thus, the present invention was completed based on the aforesaid discoveries.

The present invention is a photoconductive member provided with a photoconductive layer including a charge-generating material and charge-transporting material superimposed over an electrically conductive substrate, wherein said photoconductive layer has a thickness of 27 μm or more, and the binding resin includes a polycarbonate resin having a numerical average molecular weight (Mn) which is 10,000 or more and is under 22,000 (low molecular weight constituent), and a polycarbonate resin having a numerical average molecular weight which is 22,000 or more and is under 38,000 (high molecular weight constituent). In the present invention, the values of the numerical average molecular weight (Mn) and the weight average molecular weight (Mw) (described later) of the polycarbonate resins are values obtained by total GPC (gel permeation chromatography).

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
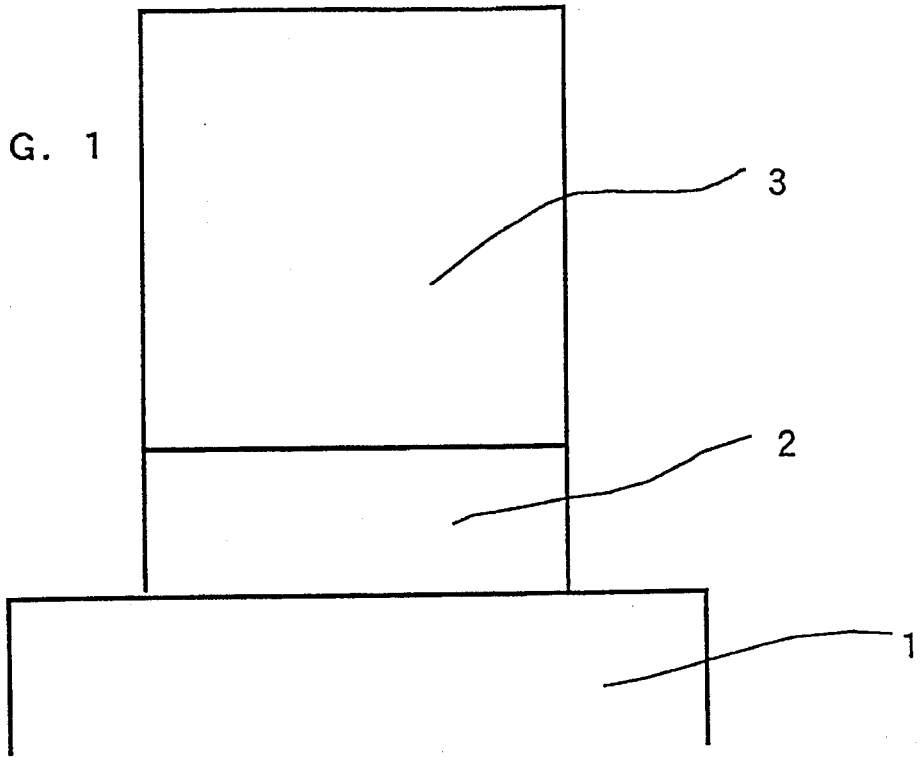
FIG. 1 is a modal section view showing a photoconductive member of the present invention having a, laminate structure of a charge-generating layer 2 and a charge-transporting layer 3 superimposed over an electrically conductive substrate 1.

An embodiment of the present invention is a photoconductive member provided with a photoconductive layer including a charge-generating material and charge-transporting material superimposed over an electrically conductive substrate, wherein said photoconductive layer has a thickness of 27 μm or more, and the binding resin includes a polycarbonate resin having a numerical average molecular weight (Mn) which is 10,000 or more and is under 22,000 (low molecular weight constituent), and a polycarbonate resin having a numerical average molecular weight which is 22,000 or more and is under 38,000 (high molecular weight constituent).

Low molecular weight constituents reduce viscosity, and are effective in achieving uniform dispersion of materials as well as decreasing the viscosity of the entire binding resin, but produce a loss of uniformity in the application layer. On the other hand, high molecular weight constituents act effectively to assure adequate mechanical strength of the photoconductive member, but increase viscosity and cause difficulty in forming a thick photoconductive layer as well as causing irregularities in the drying process due to a loss of leveling. Accordingly, the present invention resolves the previously described technical subjects of the invention to compensate for various defects and achieve viscosity regulation.

When a carbonate resin having a numerical mean molecular weight of less than 10,000 is used as the binding resin for the photoconductive layer, viscosity is excessively lowered such that a uniform application layer is difficult to obtain, and construction of a thick layer is also difficult. Furthermore, layer strength is also reduced, thereby adversely affecting print resistance. When a carbonate resin having a numerical mean molecular weight greater than 38,000 is used, adequate mechanical strength is assured, but it is difficult to remove toner adhering to the surface of the photoconductor by a cleaning process, thereby leading to "filming" which produces image noise. When the numerical mean molecular weight value increases, solubility characteristics in a solvent is adversely affected, and uniform dispersion of the charge-transporting layer and the like cannot be obtained because viscosity is also increased, such that applicability and production characteristics are reduced. Therefore, in the present invention, at least one type of polycarbonate resin having a numerical mean molecular weight of 10,000 or more and less than 22,000, and at least one type of polycarbonate resin having a numerical mean molecular weight of 22,000 or more and less than 38,000 are combined in various repeating units, described later, for use as a binding resin for a thick-film photoconductive layer. Thus, it is possible to simultaneously satisfy assurance of the low viscosity characteristics of a low molecular weight constituent, filming preventability, and uniform dispersion characteristics of the materials, and further assure improvement of the mechanical strength of the layer having a high molecular weight constituent, such that a suitable binding resin can be obtained for use in a thick film photoconductive layer. In the case of a photoconductive layer of 30 μm or more, it is desirable to use a constituent having a numerical mean molecular weight of 10,000 or more and under 20,000, and a constituent having a numerical mean molecular weight of 22,000 or more and under 38,000. Furthermore, it is desirable that the difference in the numerical mean molecular weights of the low molecular weight constituent and the high molecular weight constituent is 5,000 or more and under 25,000, and preferably 5,000 or more and under 10,000. Although layer strength and wear resistance is improved with a greater ratio of Mn/Mw of the high molecular weight constituent of the polycarbonate, uniform application becomes difficult as viscosity increases, such that a ratio of 3~7 is desirable. On the other hand, excellent compatibility with the charge-transporting material can be obtained when the Mn/Mw ratio of the low molecular weight constituent is 2~5. Thus, when the formulation ratios of the respective polycarbonate resins is within the range 1/9~9/1, and ideally within a range 1/4~4/1, suitable mixing ratios can be selected with regard to wear resistance, ease of viscosity regulation of the application fluid, pot-life and the like.

The aforesaid polycarbonate resins may be used as the binding resin of the charge-transporting layer in a photoconductive member wherein a photoconductive layer comprises a lamination of a charge-generating layer and a charge-transporting layer.

The aforesaid photoconductive layer has excellent wear resistance and cleaning characteristics, and is relatively unaffected by deterioration due to ozone and the like. The photoconductive member of the present invention having the previously described photoconductive layer is not subject to whitening (gelation) of the application liquid during manufacture nor solvent cracking, and even when used repeatedly over a long-term period, excellent mechanical strength and electrophotographic characteristics were maintained, thereby providing excellent repetition stability and image fidelity. The aforesaid photoconductive member may also be used in fields other than electrophotographic copying apparatus which use electrophotographic photoconductive toner and the like.

Linear polymers having repeating units of one type or two or more types of constituents as represented in general formula (I) below may be used as the aforesaid polycarbonate resins.

[Formula 1]

[I]

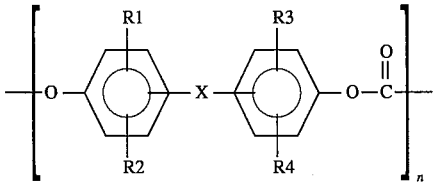

(Wherein R1~R4 independently represent a hydrogen atom, a halogen atom, an alkyl group, an aryl group, and a cyclo-alkyl group.) Specific examples of R1~R4 include halogen atoms such as fluorine atoms, chlorine atoms, bromine atoms and the like, and methyl groups, ethyl groups, n-propyl groups, isopropyl groups, n-butyl groups, 1-methylpropyl groups, 2-methylpropyl groups, tert-butyl groups, n-pentyl groups, isopentyl groups, neopentyl groups, n-hexyl groups, isohexyl groups, phenyl groups, cyclohexyl groups and the like.

R1~R4 may be identical groups, or may be different groups.

X represents a single bond, —(R5)C(R6)—(in the formula, R5 and R6 independently represent a hydrogen atom, —$CH_3$, alkyl group, or allyl group), —$(CH_2)_q$—(q represents and integer of 1~10), —O—, —S, —SO— and —$SO_2$—. R5 and R6 may form a ring bond integratedly.

Although n represents an integer of 20 or more, this value may vary in accordance with the low lolecular weight constituent and hogh molecular weight constituent.

Specific examples of R5 and R6 in the aforesaid —(R5)C(R6)— include hydrogen atom, trifluoromethane group, methyl group, ethyl group, n-propyl group, isopropyl group, n-butyl group, 1-methylpropyl group, 2-methylpropyl group, tert-butyl group, n-pentyl group, isopentyl group, n-hexyl group, isohexyl group, phenyl group, tolyl group, xylyl group, trimethylphenyl group, ethylphenyl group, naphthyl group, methylnaphthyl group, biphenyl group and the like. Particularly useful among the aforesaid examples are methyl group, and phenyl group. R5 and R6 may be a mutually identical group, or may be different groups.

Particularly desirable among the aforesaid —(R5)C(R6)— are the following structures:

Examples of R5 and R6 ring formations include 1,1-cyclopentylidene group, 1,1-cyclohexylidene group, 1,1-cyclooctylidene group and the like. Particularly desirable among the aforesaid is 1,1-cyclohexylidene group.

[Formula 2]

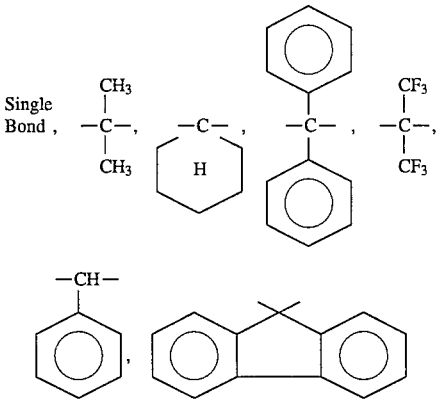

Examples of the aforesaid —$(CH_2)_q$— include methylene group, methylene group, dimethylene group, trimethylene group, tetramethylene group, hexamethylene group, octamethylene group, decamethylene group and the like.

The polycarbonate resin represented by general formula (I) can be manufactured by a general polycarbonate synthesizing method by reacting one type or two or more types of the biatomic phenols represented by general formula (II) below with phosgene.

[Formula 3]

[II]

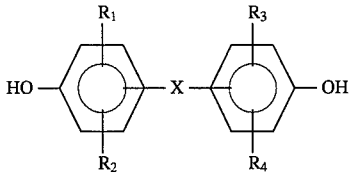

Useful examples of diatomic phenyls represented in the aforesaid general equation II include bis(4-hydroxyphenyl-)methane, 1,1-bis(4-hydroxypneol)ethane, 1,2-bis(4-hydroxyphenyl)ethane, 2,2-bis(4-hydroxyphenyl)propane, 2,2-bis(s-methyl-4-hydroxyphenyl)butane, 2,2-bis(4-hydroxyphenyl)butane, 2,2-bis(4-hydroxyphenyl)octane, 4,4-bis(4-hydroxyphenyl)heptane, 1-phenyl-1,1-bis(4-hydroxyphenyl)ethane, 4,4'-dihydroxytetraphenyl methane, 1,1-bis(4-hydroxyphenyl)-1-phenyl ethane, 1,1-bis(4-hydroxyphenyl)-1-phenyl methane, bis(4-hydroxyphenyl)ether, bis(4-hydroxyphenyl)sulfide, bis(4-hydroxyphenyl)sulfone, 1,1-bis(4-hydroxyphenyl)cyclopentane, 1,1-bis(4-hydroxyphenyl)cyclohexane, 2,2-bis(3-methyl-4-hydroxyphenyl)propane, 2-(3-methyl-4-hydroxyphenyl)-2-(4-hydroxyphenyl)-1-phenyl ethane, bis(3-methyl-4-hydroxypenyl)sulfide, bis(3-methyl-4-hydroxyphenyl)sulfone, bis(3-methyl-4-hydroxyphenyl)methane, 1,1-bis(3-methyl-4-hydroxyphenyl)cyclohexane, 4,4'-dihydroxy biphenyl, 2,2-bis2-methyl-4-hydroxyphenyl)propane, 1,1-bis2-butyl-4-hydroxy-5-methylphenyl)butane, 1,1-bis(2-tert-butyl-4-hydroxy-3-methylphenyl)ethane, 1,1-bis(2-tert-butyl-4-hydroxy-5-methylphenyl)propane, 1,1-bis(2-tert-butyl-4-hydroxy-5-methylphenyl)butane, 1,1-bis(2-tert-butyl-4-hydroxy-5-methylphenyl)isobutane, 1,1-bis(2-tert-butyl-4-hydroxy-5-methylphenyl)heptane, 1,1-bis(2-tert-butyl-4-hydroxy-5-methylphenyl)-1-phenylmethane, 1,1-bis(2-tert-amyl-4-hydroxy-5-methylphenyl)butane, bis(3-chloro-4-hydroxyphenyl)methane, bis(3,5-dibromo-4-hydroxyphenyl)methane, 2,2-bis(3-chloro-4-hydroxyphenyl)propane, 2,2-bis(3-fluoro-4-hydroxyphenyl)propane, 2,2-bis(3-dibromo-4-hydroxyphenyl)propane, 2,2-bis(3,5-difluoro-4-hydroxyphenyl)propane, 2,2-bis(3,5-dichloro-4-hydroxyphenyl)propane, 2,2-bis(3,5-dibromo-4-hydroxyphenyl-)propane, 2,2-bis(3-dibromo-4-hydroxy-5-chlorophenyl)propane, 2,2-bis(3,5-dichloro-4-hydroxyphenyl)butane, 2,2-bis(3,5-dibromo-4-hydroxyphenyl)butane, 1,1-bis(3-fluoro-4-hydroxyphenyl)-1-phenylethane, bis(3-fluoro-4-hydroxyphenyl)ether, 3,3'-difluoro-4,4'-dihydroxybiphenyl, 1,1-bis(3-cyclohexyl-4-hydroxyphenyl)cyclohexane, 2,2-bis(4-hydroxyphenyl)hexafluoropropane, 2,2-bis(3-phenyl-4-hydroxyphenyl)propane, 1-phenyl-1,1-bis(3-phenyl-4-hydroxyphenyl)ethane, 1,1-bis(3-phenyl-4-hydroxyphenyl)cyclohexane, 9.9-bis(4-hydroxyphenyl)fluorene, 1,3-bis(3-phenyl-4-hydroxyphenyl)pentane, bis(3-phenyl-4-hydroxyphenyl)sulfone, 3,3'-diphenyl-4,4'-dihydroxybiphenyl, bis(3-phenyl-4-hydroxyphenyl)methane, 1-phenyl-1,1-bis(3-phenyl-4-hydroxyphenyl)methane, 1,1-bis(3-phenyl-4-hydroxyphenyl)ethane, 1,2-bis(3-phenyl-4-hydroxyphenyl)ethane, 1,3-bis(3-phenyl-4-hydroxyphenyl)propane, 2,2-bis(3-phenyl-4-hydroxyphenyl)butane, 1,4-bis(3-phenyl-4-hydroxyphenyl)butane, 1,1-bis(3-phenyl-4-hydroxyphenyl)-1-phenylbutane, 2,2-bis(3-phenyl-4-hydroxyphenyl)octane, 1,8-bis(3-phenyl-4-hydroxyphenyl)octane, bis(3-phenyl-4-hydroxyphenyl)ether, bis(3-phenyl-4-hydroxyphenyl)sulfide, 1,1-bis(3-phenyl-4-hydroxyphenyl)cyclopentane and the like.

Among the aforesaid examples, particularly useful examples from the perspectives of electrophotographic characteristics and solubility include 2-bis(4-hydroxyphenyl-)propane, 1-phenyl-1,1-bis(4-hydroxyophenyl)ethane, 4,4'-dihydroxytetraphenylmethane, bis(4-hydroxyphenyl)sulfone, 1,1-bis(4-hydroxyphenyl)cyclohexane, 2,2-bis(3-methyl-4-hydroxyphenyl)propane, 4,4'-dihydroxypbiphenyl, 2,2-bis(3-phenyl-4-hydroxyphenyl)propane, 1-phenyl-1,1-bis(3-phenyl-4-hydroxyphenyl)ethane, 1,1-bis(3-phenyl-4-hydroxyphenyl)cyclohexane, 9,9-bis(4-hydroxyphenyl)fluorene, bis(3-phenyl-4-hydroxyphenyl)sulfone and the like.

The configuration of the photoconductive member of the present invention is adaptable to various conventional configurations, including laminate constructions comprising a charge-generating layer and a charge-transporting layer superimposed over an electrically conductive substrate, and monolayer constructions comprising charge-genrating materials and charge-transporting materials dispersed in resin.

Figure 2:
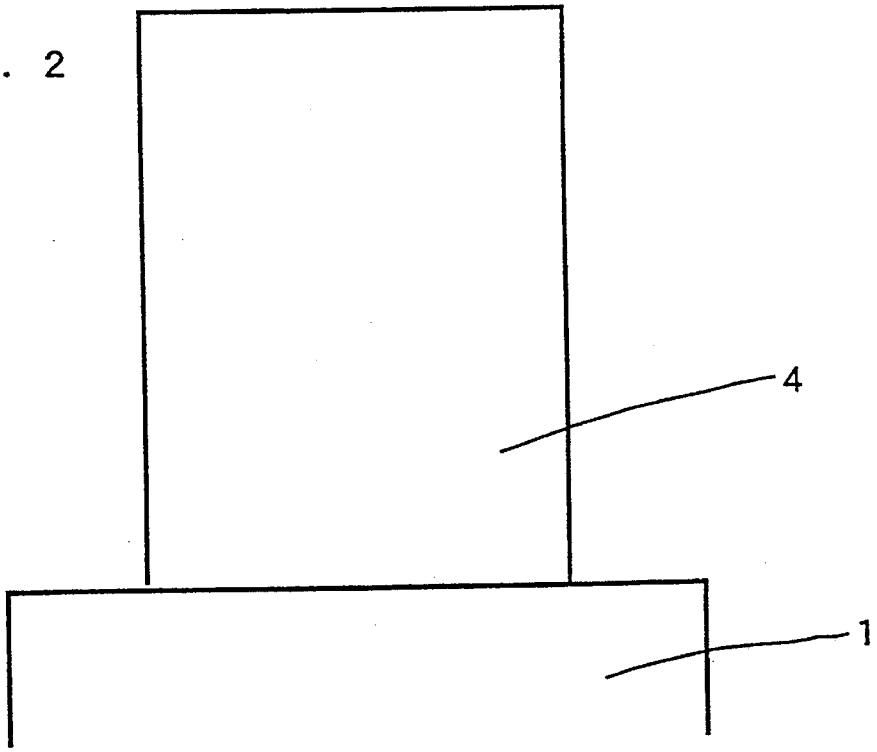
FIG. 2 is a modal section view showing a photoconductive member of the present invention having a photoconductive layer 4 superimposed over an electrically conductive substrate 1.
Figure 3:
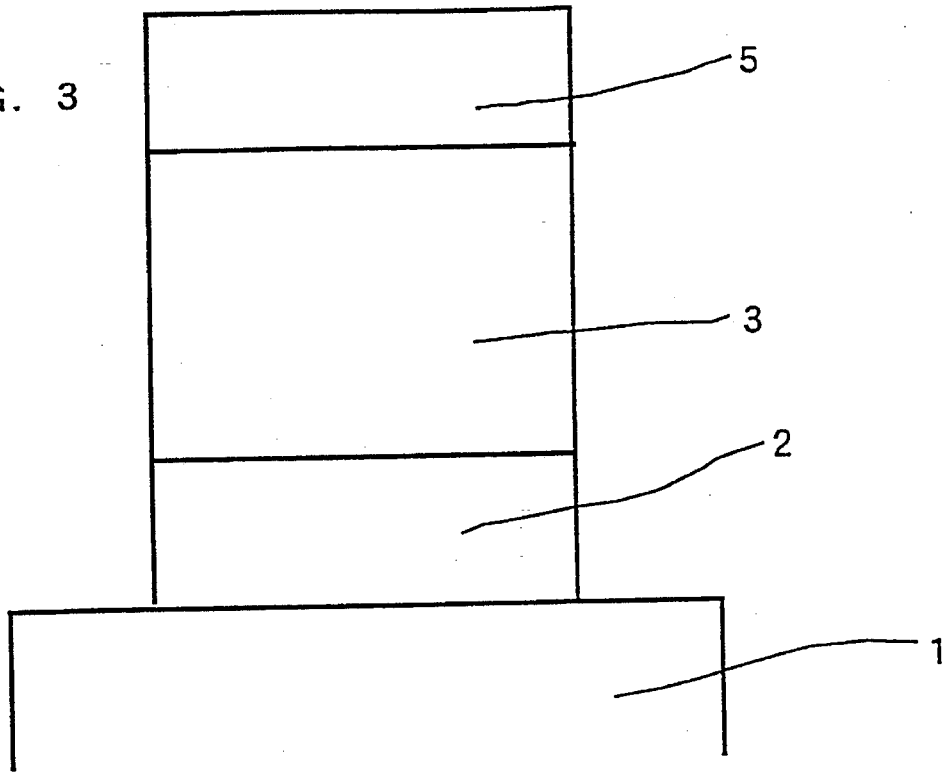
FIG. 3 is a modal section view showing a photoconductive member of the present invention provided with a surface overcoat layer 5 on the surface of a laminate type photoconductive member.
Figure 4:
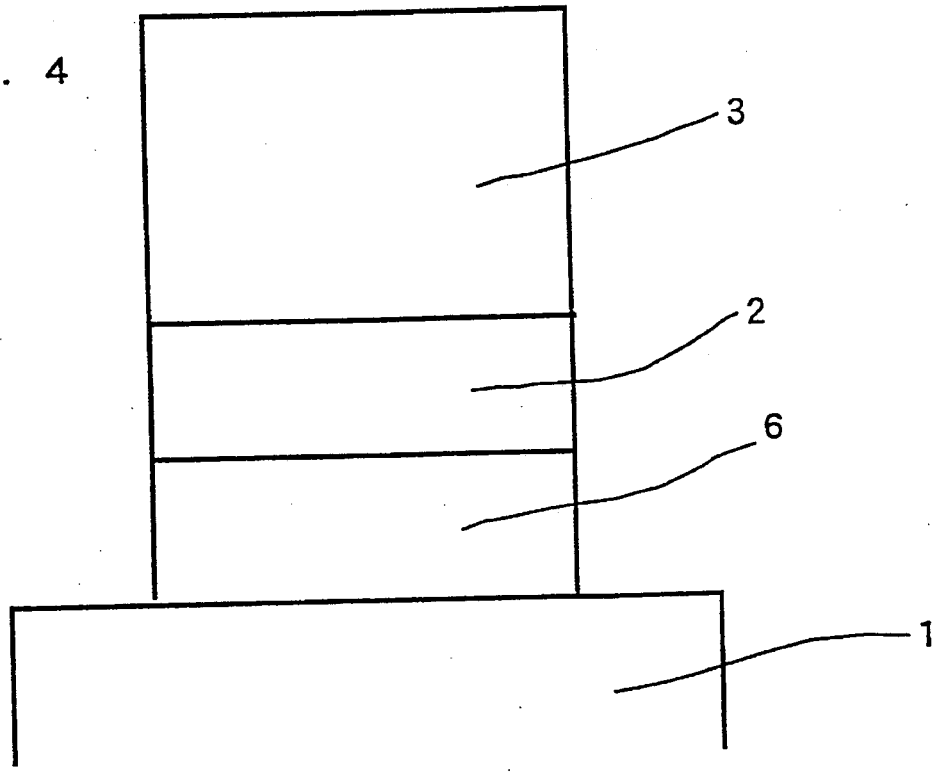
FIG. 4 is a modal section view showing a photoconductive member of the present invention having an intermediate layer 6 interposed between a charge-generating layer 2 superimposed over an electrically conductive substrate 1.

Examples of useful configurations include function-separated type laminate photoconductive members comprising an electrically conductive substrate 1 over which is sequentially superimposed a charge-generating layer 2 including charge-generating material, and a charge-transporting layer 3 including charge-transporting material, such as that shown in FIG. 1; or monolayer photoconductive members comprising an electrically conductive substrate 1 over which is superimposed a photoconductive layer 4 including charge-generating material and charge-transporting material in a binding resin, such as that shown in FIG. 2; or photoconductive members provided with an overcoat protective layer 5 superimposed over the surface of the photoconductive member of FIG. 1, such as that shown in FIG. 3; or photoconductive members providing an intermediate layer 6 interposed between a charge-transporting layer 3 superimposed over electrically conductive substrate 1, such as that shown in FIG. 4.

The photoconductive member of the present invention is described in detail by way of specific examples such as a laminated photoconductive member having a charge-generating layer and a charge-transporting layer including a polycarbonate resin of the present invention superimposed over an electrically conductive substrate such as that shown in FIG. 1.

The laminate type photoconductive member of the present invention shown in FIG. 1 is manufactured by either superimposing a charge-generating material over an electrically conductive substrate by vapor deposition or plasma polymerization, or applying and drying on the surface of an electrically conductive member a dispersion fluid formed by dispersing charge-generating material in a solvent containing a suitable dissolved resin so as to produce a charge-generating layer, and thereafter superimposing over said charge-generating layer an application of a solution including charge-transporting material and polycarbonate resin and drying same so as to produce a charge-transporting layer. Application of the application fluid may be accomplished by, for example, immersion coating, spray coating, spinner coating, blade coating, roller coating, wirebar coating and other common coating methods.

The thickness of the charge-generating layer of the photoconductive member of the present invention may be 0.01~2 μm, and preferably 0.05~0.5 μm. If too little charge-generating material is used, sensitivity is reduced, whereas if too much is used, mechanical strength is weakened and charging characteristics deteriorate. Therefore, the ratio of charge-generating material included in the charge-generating layer relative to 1 part-by-weight of binding resin may be 0.1~10 parts-by-weight, and preferably 0.2~5 parts-by-weight.

Examples of useful charge-generating materials for use in the charge-generating layer include organic pigments such as bisazo pigments, triarylmethane dyes, thiazine dyes, oxazine dyes, xanthene dyes, cyanine dyes, styryl pigment, beryllium dyes, azo pigments, quinacridone, indigo pigment, perylene pigment, polycyclic kenone pigments, polycyclic quinone pigments, bisbenzimidazole pigment, indanthrone pigment, squaryllium pigment, phthalocyanine pigment and the like, and inorganic materials such as selenium, selenium-arsenic, selemium-tellurium, cadmium sulfide, zinc oxide, titanium oxode, titanium oxide, amorphous silicone and the like. Various other materials may be used if such materials produce a charge-carrying member with extremely high yield.

Examples of useful resins for use as charge-generating material include thermoplastic binding agents such as saturated polyester resin, polyamide resin, acrylic resin, ethylene-vinyl acetate copolymer, ion exchange olefin copolymer (ionomer), styrene-butadiene block copolymer, polyarylate, polycarbonate, vinyl chloride-vinyl acetate copolymer, cellulose ester, polyimide, styrol resin, polyacetal resin, phenoxy resin and the like, thermoset binding agents such as epoxy resin, urethane resin, silicon resin, phenol resin, melamine resin, xylene resin, alkyd resin, thermoset acrylic resin and the like, and photoconductive resins such as photo-setting resin, poly-N-vinylcarbazole, polyvinylpyrene, polyvinylanthracene and the like.

The previously mentioned charge-generating materials and the aforesaid resins may be dispersed or dissolved in organic solvents such as alcohols such as methanol, ethanol, isopropanol and the like, ketones such as acetone, methylethylketone, cyclohexane and the like, amides such as N,N-dimethylformamide, N,N-dimethylacetoamide, sulfoxides such as dimethylsulfoxide and the like, ethers such as tetrahydrofuran, dioxane, ethyleneglycolmonomethyl ether, esters such as methylacetate, ethylacetate and the like, fatty hologenated hydrocarbon resins such as chloroform, methylene chloride, dichloroethylene, carbon tetrachloride, trichloroethylene and the like, or aromatics benzene, toluene, xylene, ligroin, monochlorobenzene, dichlorobenzene and the like so as to produce a photoconductive application fluid which is applied on the electrically conductive substrate, dried, toproduce the charge-generating layer.

The electrically conductive substrate may be foil or plate of copper, aluminum, iron, nickel and the like formed in a drum shape. The aforesaid metals may have a plastic film or the like deposited thereon by vacuum deposition, electroless plating, or a conductive compound layer of electrically conductive polymer, indium oxide, tin oxide and the like may be applied to paper or plastic film by vapor deposition. Generally, a cylindrical aluminum member is used. Specific examples of such members include members wherein an aluminum pipe is sectioned after extrusion and drawing processes, and the exterior surface is machined using a cutting tool such as a diamond bite or the like in about 0.2~0.3 mm sections (machined tube), members wherein an aluminum disk is formed in to a cup shape and the exterior surface is finished by die coating process (DI tube), members wherein an aluminum disk is formed int a cup shape by impact processing, and the exterior surface is finished by die coating process (EI tube), and members which are extruded, then subjected to cold drawing process (ED tube). The aforesaid surfaces may also be machined.

An application fluid comprising charge-transporting material and the polycarbonate resin of the present invention dissolved in a suitable solvent is applied onto the charge-generating layer formed on the previously described conductive substrate, and dried to form a charge-transporting layer 27~70 μm in thickness, and preferably $30^{-60}$ μm in thickness. When the ratio of charge-transporting material in the charge-transporting layer is too low, sensitivity is reduced, whereas too high a ratio adversely affects charging characteristics and weakens mechanical strength of the photoconductive layer. Therefore, the charge-transporting material content in the charge-transporting layer relative to 1 part-by-weight of the binding resin is desirably 0.02~2 parts-by-weight, and preferably 0.5~1.2 parts-by-weight.

Examples of useful charge-transporting materials for use in forming a charge-transporting layer include hydrazone compounds, pyrazoline compounds, styryl compounds, triphenylmethane compounds, oxadiazol compounds, carbazole compounds, stilbene compounds, enamine compound-soxazole compounds, triphenylamine compounds, triphenylbenzidine compounds, azine compounds and the like. Specific examples of the aforesaid include carbazole, N-ethylcarbazole, N-vinylcarbazole, N-phenylcarbazole, tetrazene, chrysene, pyrene, 2-phenylnaphthalene, azapyrene, 2,3-benzochrysene, fluorene, 1,2-benzofluorene, 4-2-fluorenylazo)resorcinol, 2-p-anizolaminofluorene, p-diethylaminoazobenzene, cadion, N,N-dimethyl-p-phenylazoaniline, p-(dimethylamino)stilbene, 1,4-bis(2-methylstyryl)benzene, 9-(4-diethylaminostyryl)anthracene, 2,5-bis(4-diethylaminophenyl)-1,3,5-oxadiazole, 1-phenyl-3-(p-diethylaminostyryl)-5-(p-diethylaminophenyl)pyrazoline, 1-phenyl-3-phenyl-5-pyrazoline, 2-(m-naphthyl)-3-phenyloxazole, 2-(p-diethylaminostyryl)-6-diethylaminobenzoxazole, 2-(p-diethylaminostyryl )-6-diethylaminobenzothiazole, bis(4-diethylamino-2-methylphenyl)phenylmethane, 1,1-bis(4-N,N-diethylamino-2-ethylphenyl)heptane, N,N-diphenylhydrazino-3-methylidene-10-ethylphenoxazine, N,N-diphenylhydrazino-3-methylidene-10-ethylphenothiazine, 1,1,2,2-tetrakis-(4-N,N-diethylamino-2-ethylphenyl)ethane, p-diethylaminobenzaldehyde-N,N-diphenylhydrazone, p-diphenylaminobenzaldehyde-N,N-diphenylhydrazone, N-ethylcarbazole-N-methyl-N-phenylhydrazone, p-diethylaminobenzaldehyde-3-methylbenzthiazolinone-2-hydrazone, 2-methyl-4-N,N-diphenylamino-β-phenylstilbene, α-phenyl-4-N,N-diphenylaminostilbene, bisdiethylaminotetraphenyl butadiene and the like. Furthermore, organic glasses such as polysilane may alsobe used. The aforesaid charge-transporting materials may be used individually or in combinations of two or more thereof.

Examples of useful solvents for forming the charge-transporting layer include aromatic solvents such as benzene, toluene, xylene, chlorobenzene and the like, ketones such as acetone, methylethylketone, cyclohexanone and the like, alcohols such as methanol, ethanol, isopropanol and the like, esters such as ethylacetate, ethyl cellosolve and the like, halogenated hydrocarbons such as carbon tetrachloride, carbone tetrabromide, chloroform, dichloromethane, tetrachloroethane and the like, ether such as tetrahydrofuran, dioxane and the like, dimethylformamide, dimethylsulfoxide, diethylformamide and the like. These solvents may be used in individually, or two types or more may be used to form combination solvents.

The photoconductive member of the present invention may also be provided with an intermediate layer interposed between the conductive substrate and the photoconductive layer. Provision of an intermediate layer will improve adhesion characteristics, application characteristics will be improved, the substrate will be protected, and charge injection from the substrate side to the photoconductive layer can be suppressed. Useful materials for the intermediate layer include polymers such as polyimide, polyamide, nitrocellulose, polyvinylbutyral, polyvinylalcohol and the like, which may be used directly or in a dispersion with tin oxide, indium oxide or like low resistance compound, or vapor deposition film of aluminum oxide, zinc oxide, silicon oxide and the like. A layer thickness of 1 μm or less is desirable.

The photoconductive member of the present invention may further be provided with a protective overcoat layer. Examples of useful materials for an overcoat layer include acrylic resin, polyaryl resin, polycarbonate resin, urethane resin and like polymers used directly or dispersed with tin oxide, indium oxide or like low resistance compounds. Further, organic plasma polymer layers may be used as an overcoat layer. The organic plasma polymer layer may include atoms of oxygen, nitrogen, halogen, Group III of the periodic table, and Group V of the periodic table. The thickness of the overcoat layer is desirably 5 μm or less.

Although the preferred embodiments of the invention are described by way of example hereinafter, it is to be understood that the invention is not limited to said examples insofar as the scope of the invention is not exceeded. In the following description "part" shall indicate "parts-by-weight" unless otherwise specified.

EXAMPLE 1

A sandmill was used to disperse 0.45 parts bisazo compound expressed by the formula below with 0.45 parts polyester resin (BYLON 2000; Toyobo Co., Ltd.) and 50 parts cyclohexanone for 48 hrs. The obtained bisazo compound dispersion fluid was applied by immersion on an aluminum drum (major diameter: 80 mm; length: 340 mm), and dried to form a charge-generating layer 0.3 μm in thickness.

[Formula 4]

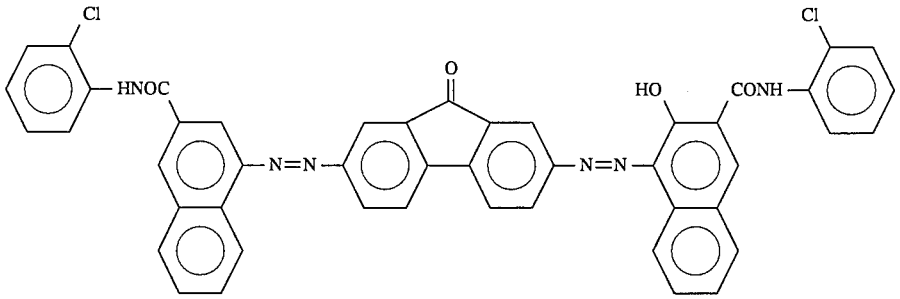

Upon the aforesaid layer was superimposed 50 parts distyryl compound having the structure shown below,

[Formula 5]

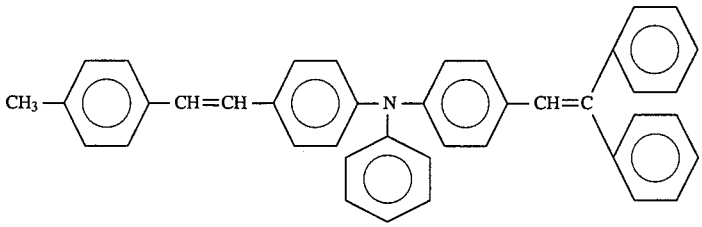

and 30 parts polycarbonate resin having a numerical mean molecular weight (Mn) of $2.5\times10^3$ (Mw/Mn=4.7) and 40 parts polycarbonate resin having a numerical mean molecular weight (Mn) of $1.8\times10^3$ (Mw/Mn=2.8) represented by the structural units shown below,

[Formula 6]

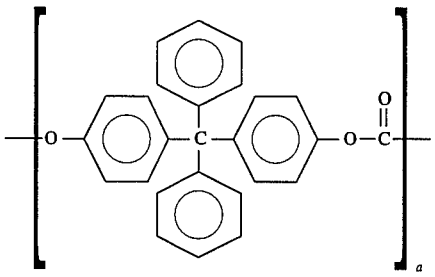

were dissolved in a solvent mixture comprising 250 parts tetrahydrofuran and 250 parts 1,4-dioxane, so as to form-a charge-transporting layer by immersion application with a dried film thickness of 30 μm. A laminate type photoconductive member having a photoconductive layer comprising two layers was thus obtained.

EXAMPLE 2

To 50 parts tetrahydrofuran (THF) were added 1 part titanylphthalocyanine and 1 part polyvinylbutyral and the mixture was dispersed for 4 hrs using a sandmill. The obtained dispersion fluid was applied on an aluminum drum (major diameter 80 mm; length 340 mm) provided with an anodized surface so as to form a charge-transporting layer by immersion application with a dried film thickness of 0.2 μm.

Upon the aforesaid layer was superimposed 50 parts diamino compound having the structure shown below,

[Formula 7]

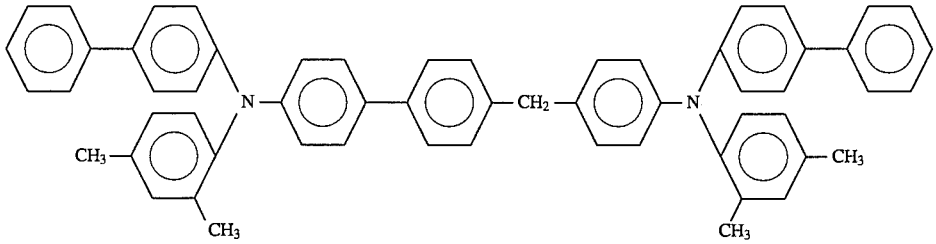

and 40 parts polycarbonate resin having a numerical mean molecular weight (Mn) of $1.5\times10^3$ (Mw/Mn)=2.6) represented by the structural units below

[Formula 8]

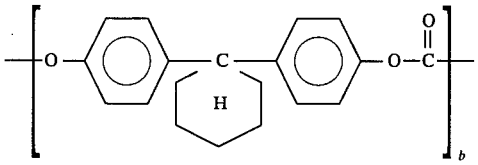

and 10 parts polycarbonate resin having a numerical mean molecular weight (Mn) of $3.6\times10^3$ represented by the structural units below

[Formula 9]

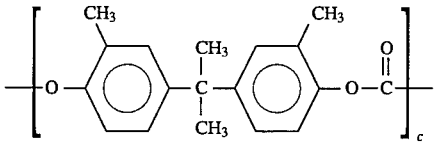

and 1.5 parts dicyano compound represented by the structural units below

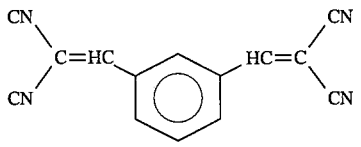

[Formula 10]

and 4 parts di-tert-butylhydroxytoluene were dissolved in 500 parts dichloroethane to form a solvent solution which was applied by immersion and dried to form a charge-transporting layer having a dried layer thickness of 35 μm. A laminate type photoconductive member having a photoconductive layer comprising two layers was thus obtained.

EXAMPLE 3

To 100 parts cyclohexanone were added 1 part trisazo compound represented by the structural formula below

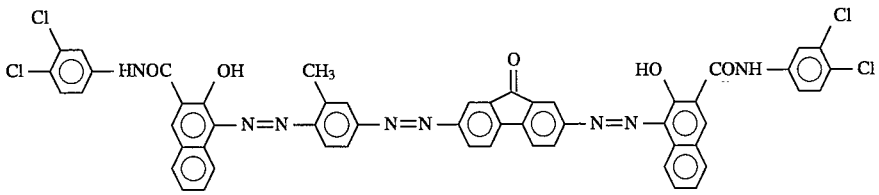

[Formula 11]

one part butyral resin (6000C; Denki Kagaku K.K.), and 1 part phenoxy resin (PKHH; Union Carbide Corp.) which were dispersed for 48 hrs using a sandmill. The obtained trisazo compound dispersion fluid was applied by immersion on an aluminum drum (major diameter 80 mm; length 340 mm) and dried to form a charge-generating layer having a dried layer thickness of 0.2 μm.

In a solvent mixture of 250 parts tetrahydrofuran and 250 parts 1,4-dioxane were dissolved 50 parts diamino compound represented by the structural formula below

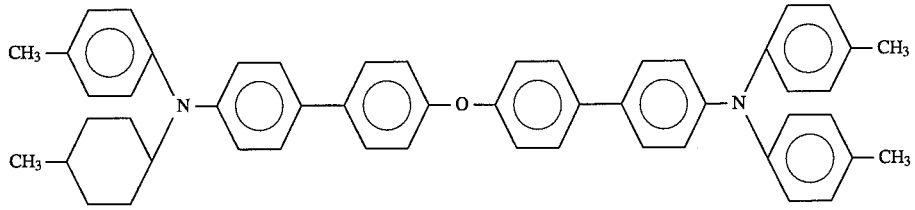

[Formula 12]

and 30 parts polycarbonate resin having a numerical mean molecular weight (Mn) of $2.1\times10^3$ (Mw/Mn=4.1) represented by the structural formula below

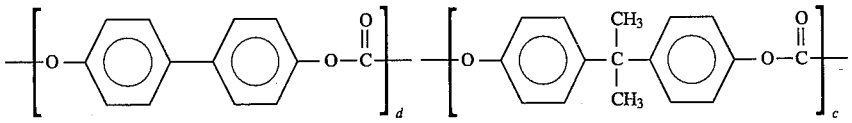

[Formula 13]

and 20 parts polycarbonate resin having a numerical mean molecular weight (Mn) of $2.8\times10^3$ (Mw/Mn=4.8) to form a solvent solution in which the aforesaid member was immersed and dried to form a charge-transporting layer having a dried layer thickness of 40 μm. A laminate type photoconductive member having a photoconductive layer comprising two layers was thus obtained.

EXAMPLE 4

A laminate type photoconductive member was produced in the same manner as described in Example 3 with the exception that 45 parts polycarbonate resin having a numerical mean molecular weight (Mn) of $2.7\times10^3$ (Mw/Mn=4.5), and 15 parts polycarbonate resin having a numerical mean molecular weight (Mn) of $1.7\times10^3$ (Mw/Mn=3.8) represented by the structural formula below were used as the binding resin of the charge-transporting layer.

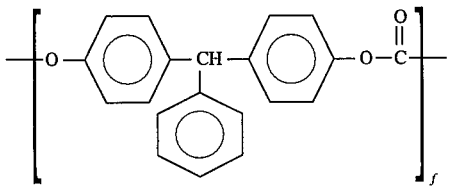

[Formula 14]

EXAMPLE 5

A laminate type photoconductive member was produced in the same manner as described in Example 3 with the exception that 20 parts polycarbonate resin having a numerical mean molecular weight (Mn) of $2.0\times10^3$ (Mw/Mn=4.0) represented by the structural formula below

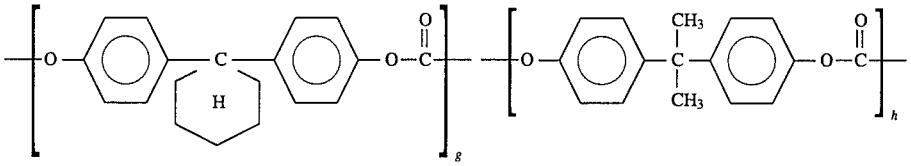

[Formula 15]

and 40 parts polycarbonate resin having a numerical mean molecular weight (Mn) of $3.0\times10^3$ (Mw/Mn=5.6) represented by the structural formula below were used as the binding resin of the charge,transporting layer.

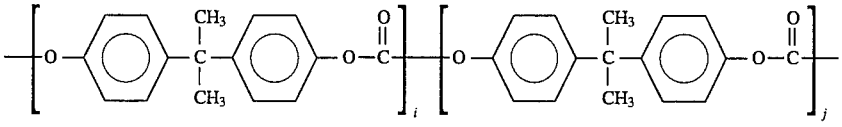

[Formula 16]

EXAMPLE 6

A laminate type photoconductive member was produced in the same manner as described in Example 3 with the exception that 30 parts polycarbonate resin having a numerical mean molecular weight (Mn) of $1.4\times10^3$ (Mw/Mn=2.8) represented by the structural formula below

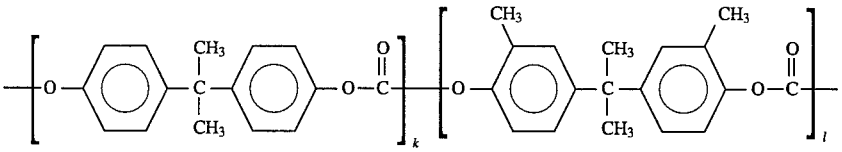

[Formula 17]

and 30 parts polycarbonate resin having a numerical mean molecular weight (Mn) of $2.5\times10^3$ (Mw/Mn=5.0) represented by the structural formula below were used as the binding resin of the charge-transporting layer.

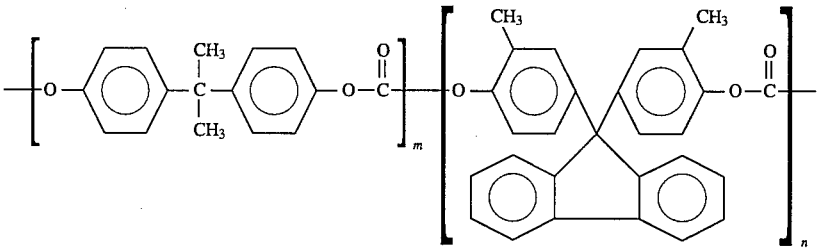

[Formula 18]

Reference Example 1

A laminate type photoconductive member was produced in the same manner as described in Example 1 with the exception that only 70 parts polycarbonate resin having a numerical mean molecular weight (Mn) of $1.8\times10^3$ (Mw/Mn=2.8) was used as the binding resin of the charge-transporting layer.

Reference Example 2

A laminate type photoconductive member was produced in the same manner as described in Example 1 with the exception that only 70 parts polycarbonate resin having a numerical mean molecular weight (Mn) of $2.5\times10^3$ (Mw/Mn=4.7) was used as the binding resin of the charge-transporting layer.

Reference Example 3

A laminate type photoconductive member was produced in the same manner as described in Example 1 with the exception that 35 parts polycarbonate resin having a numerical mean molecular weight (Mn) of $0.9\times10^3$ (Mw/Mn=1.8), and 35 parts polycarbonate resin having a numerical mean molecular weight (Mn) of $7.3\times10^3$ (Mw/Mn=9.5) were used as the binding resin of the charge-transporting layer.

Reference Example 4

A laminate type photoconductive member was produced in the same manner as described in Example 1 with the exception that 35 parts polycarbonate resin having a numerical mean molecular weight (Mn) of $2.3\times10^3$ (Mw/Mn=4.6), and 35 parts polycarbonate resin having a numerical mean molecular weight (Mn) of $5.1\times10^3$ (Mw/Mn=7.6) were used as the binding resin of the charge-transporting layer.

Evaluation

The various photoconductive members produced in the previously described ways were measured for differences in thickness of the photoconductive layers at positions on the photoconductive member (2 cm from both edges), and the results of said measurements are shown in Table 2.

The aforesaid photoconductive members were installed in a commercial electrophotographic copier (model EP-5400; Minolta Co.), charged by −6 V corona discharge to achieve a surface potential of $V_0$ (V), and the initial potential decay rate DDR1 (%) was measured during a 1 sec dark discharge required to achieve decay from the initial surface potential $V_0$ to ½ thereof (hereinafter referred to as "half decay") $E_{1/2}$ (lux-sec). The measurement results are shown in Table 1.

The initial image characteristics and image characteristics after 10,000 copies were evaluated for each photoconductive member according to the Kakinoki sequence. After 10,000 copies were made, the amount of shaving of each photoconductive member was measured, and recorded as the amount of shaving of the layer per 10,000 sheets in Table 2.

Image characteristics of each photoconductive member were evaluated according to the standard below for nonprinting spots in solid image areas, image jitter in halftone image areas, black spots in halftone image areas, and image density (ID) in solid image areas. Image density was measured using a Sakura densitometer (Konica K.K.) in all cases.

Nonprinting spots:

○: nonprinting spots size less than 0.2 mm

Δ: ten or fewer nonprinting spots size of 0.2~0.8 mm

X: numerous nonprinting spots size larger than 0.2 mm

—: not measured

Image jitter

○: no density irregularities; no streak noise

Δ: density irregularities and streak noise observed, but not a problem in practice X: difference in image density ID 0.1 produced marked density irregularity and streak noise —: not measured Black spots ○: no black spots larger than 0.2 mm Δ: ten or fewer black spots size of 0.2~0.5 mm X: numerous black spots size larger than 0.2 mm —: not measured Image density ○: difference in ID greater than 1.3

Δ: difference in ID 1~1.3

X: difference in ID less than 1.0

—: not measured

TABLE 1

| | $V_0$ (V) | $E_{1/2}$ (lux-sec) | $DDR_1$ (%) |
|---|---|---|---|
| Ex. 1 | −670 | 0.6 | 2.0 |
| Ex. 2 | −680 | 0.6 | 1.7 |
| Ex. 3 | −670 | 0.5 | 2.3 |
| Ex. 4 | −660 | 0.5 | 2.1 |
| Ex. 5 | −680 | 0.5 | 1.9 |
| Ex. 6 | −670 | 0.5 | 2.0 |
| Ref Ex 1 | −670 | 0.6 | 2.1 |
| Ref Ex 2 | −670 | 0.7 | 1.8 |
| Ref Ex 3 | −660 | 0.7 | 2.5 |
| Ref Ex 4 | −670 | 0.6 | 2.3 |

TABLE 2

| | Image Characteristics | | | | | | | | Difference in layer thickness at bilateral edge of photo- | Amount shaved from layer per 1000 |
|---|---|---|---|---|---|---|---|---|---|---|
| | Initial | | | | After 10,000 copies | | | | | |
| | nonprint spots | image jitter | black dots | image density | nonprint spots | image jitter | black dots | image density | conductor (μm) | copies (μm) |
| Ex 1 | ○ | ○ | ○ | ○ | ○ | ○ | ○ | ○ | 1.0 | 0.2 |
| Ex 2 | ○ | ○ | ○ | ○ | ○ | ○ | ○ | ○ | 1.2 | 0.3 |
| Ex 3 | ○ | ○ | ○ | ○ | ○ | ○ | ○ | ○ | 1.0 | 0.2 |
| Ex 4 | ○ | ○ | ○ | ○ | ○ | ○ | ○ | ○ | 1.0 | 0.2 |
| Ex 5 | ○ | ○ | ○ | ○ | ○ | ○ | ○ | ○ | 1.1 | 0.3 |
| Ex 6 | ○ | ○ | ○ | ○ | ○ | Δ | ○ | ○ | 1.5 | 0.4 |
| Ref 1 | ○ | Δ | ○ | ○ | X | X | X | X | 6.0 | 1.6 |
| Ref 2 | ○ | Δ | ○ | ○ | X | X | X | ○ | 2.0 | 0.2 |
| Ref 3 | ○ | Δ | ○ | ○ | Δ | X | Δ | Δ | 2.6 | 0.9 |
| Ref 4 | ○ | Δ | ○ | ○ | X | X | Δ | ○ | 2.2 | 0.3 |

It can be understood from the results shown in Tables 1 and 2 that the photoconductive member of the previously described examples of the present invention have slight film thickness differences at bilateral edges of the photoconductive layer compared to that of the reference examples. Furthermore, the photoconductor of the present invention had sufficiently slight amount of layer shaving, and excellent image characteristics comparable to initial image characteristics after 10,000 copies without toner filming.

The present invention as previously described provides a photoconductive member which improves resin solubility by using polycarbonate resins having specific numerical mean molecular weights as the binding resin of a photoconductive layer, and allows the formation of a photoconductive layer having a uniform thickness by easily regulating the viscosity of an application fluid, and further provides stable electrophotographic characteristics with high sensitivity, excellent cleaning characteristics, wear resistance, and durability without fatigue due to repeated use.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A photoconductor for electrophotography comprising:

an electric conductive substrate; and a photoconductive layer including a charge generating material and a charge transporting material, and having a thickness of 27 μm or more and superimposed onto the substrate, said layer including a first polycarbonate resin having a numerical average molecular weight which is 10,000 or more and is under 22,000 and a second polycarbonate resin having a numerical average molecular weight which is 22,000 or more and is under 38,000.

2. A photoconductor as claimed in claim 1, wherein a difference of a numerical average molecular weight between the first polycarbonate resin and the second polycarbonate resin is 5,000 or more and is not more than 25,000.

3. A photoconductor as claimed in claim 1, wherein the thickness is 30 μm or more, and the first polycarbonate resin has a numerical average molecular weight which is 10,000 or more and is under 20,000.

4. A photoconductor as claimed in claim 1, wherein a ratio of the first polycarbonate resin to the second polycarbonate resin is 1/9 to 9/1.

5. A photoconductor as claimed in claim 1, wherein a ratio of the first polycarbonate resin to the second polycarbonate resin is 1/4 to 4/1.

6. A photoconductor as claimed in claim 1, wherein the first polycarbonate resin has a ratio of a weight average molecular weight to the numerical average molecular weight which is 2 or more and is not more than 5, and the second polycarbonate resin has a ratio of a weight average molecular weight to the numerical average molecular weight which is 3 or more and is not more than 7.

7. A photoconductor for electrophotography comprising:

an electrically conductive substrate;

a charge-generating layer including a charge-generating material; and a charge-transporting layer including a charge-transporting material, and having a thickness of 27 μm or more and superimposed onto the charge-generating layer, said layer including a first polycarbonate resin having a numerical average molecular weight which is 10,000 or more and is under 22,000, and a second polycarbonate resin having a numerical average molecular weight which is 22,000 or more and is under 38,000.

8. A photoconductor as claimed in claim 7, wherein said first and second polycarbonate resins have a chemical structure as presented in formula [1];

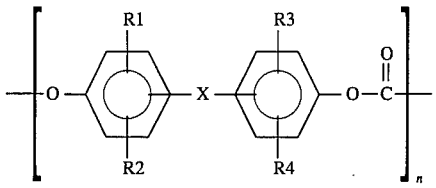

[I]

(wherein R1 to R4 independently represent a hydrogen atom, a halogen atom, an alkyl group, an aryl group, and —X— represents a single bond, —(R5)C(R6)— (wherein R5 and R6 independently represent a hydrogen atom, —CF3, an alkyl group and aryl group, said R5 and R6 form a ring bond integratedly), —(CH2)q— (wherein q represents an integer of 1 to 10), —O—, —S—, —SO— and —SO2—, and n represents an integer of 20 or more.

9. A photoconductor as claimed in claim 7, wherein the charge-transporting material is selected from the group consisting of a styryl compound and an amino compound.

10. A photoconductor as claimed in claim 7, wherein the charge-transporting material is included at 0.02 to 2 weight parts to resins of 1 weight part.

11. A photoconductor as claimed in claim 7, wherein a difference of a numerical average molecular weight between the first polycarbonate resin and the second polycarbonate resin is 5,000 or more and is not more than 25,000.

12. A photoconductor as claimed in claim 7, wherein the thickness is 30 μm or more, and the first polycarbonate resin has a numerical average molecular weight which is 10,000 or more and under 20,000.

13. A photoconductor s claimed in claim 7, wherein a ratio of the first polycarbonate resin to the second polycarbonate resin is 1/9 to 9/1.

14. A photoconductor as claimed in claim 7, wherein a ratio of the first polycarbonate resin to the second polycarbonate resin is 1/4 to 4/1.

15. A photoconductor as claimed in claim 7, wherein the first polycarbonate resin has a ratio of a weight average molecular weight to the numerical average molecular weight which is 2 or more and is not more than 5, and the second polycarbonate resin has a ratio of a weight average molecular weight to the numerical average molecular weight which is 3 or more and is not more than 7.

16. A photoconductor for electrophotography comprising:

an electrically conductive substrate; and a photoconductive layer including a charge generating material and a charge transporting material having a thickness of 27 μm or more and superimposed onto the substrate, said layer including a first polycarbonate resin having a numerical average molecular weight which is 10,000 or more and under 22,000, and a second polycarbonate resin having a numerical average molecular weight which is 22,000 or more and under 38,000, said first and second polycarbonate resins having a chemical structure as presented in formula [I];

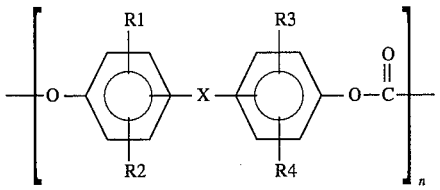

[I]

wherein $R_1$, $R_2$, $R_3$ and $R_4$ are independently selected from the group consisting of a hydrogen atom, a halogen atom, an alkyl group, an aryl group, or a cyclo-alkyl group; X is selected from the group consisting of a single bond, —(R5)C(R6) wherein R5 and R6 are independently selected from the group consisting of a hydrogen atom, —CF3, an alkyl group and aryl group, or R5 and R6 form a ring bond, —$(CH_2)$q— wherein q is an integer from 1 to 10, —O—, —S—, —SO— and —$SO_2$—; and n is an integer of 20 or more.

17. A photoconductor as claimed in claim 16, wherein the formula [I] is represented by the following formula;

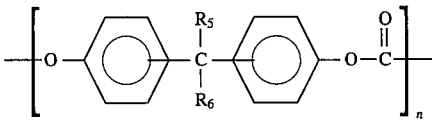

wherein R5 and R6 are independently selected from the group consisting of a methyl group and a phenyl group.

18. A photoconductor as claimed in claim 7, wherein said first and second polycarbonate resins have a chemical structure as presented in formula [1];

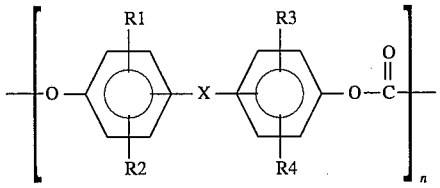

[I]

wherein $R_1$, $R_2$, $R_3$ and $R_4$ are independently selected from the group consisting of a hydrogen atom, a halogen atom, an alkyl group, an aryl group, or a cyclo-alkyl group; X is selected from the group consisting of a single bond, —(R5)C(R6) wherein R5 and R6 are independently selected from the group consisting of a hydrogen atom, —CF3, an alkyl group and aryl group, or R5 and R6 form a ring bond, —$(CH_2)$q— wherein q is an integer from 1 to 10, —O—, —S—, —SO— and —$SO_2$—; and n is an integer of 20 or more.

* * * * *